United States Patent [19]

Groombridge et al.

[11] 4,162,548

[45] Jul. 31, 1979

[54] WATER CLOSETS

[75] Inventors: Frederick W. H. Groombridge, Welwyn; Ronald N. Butler, Prestwood, both of England

[73] Assignee: Celanese Corporation, New York, N.Y.

[21] Appl. No.: 881,310

[22] Filed: Feb. 27, 1978

[30] Foreign Application Priority Data

Apr. 13, 1977 [GB] United Kingdom ..... 15298/77

[51] Int. Cl.[2] ..... E03D 1/00; E03D 3/00; E03D 5/00; E03D 11/00

[52] U.S. Cl. ..... 4/300; 4/329; 4/353; 4/417; 4/418

[58] Field of Search ..... 4/300, 417, 332, 343, 4/320, 329, 318, 328, 321, 314, 342, 418, 420, 353, 311

[56] References Cited

U.S. PATENT DOCUMENTS

| | | | |
|---|---|---|---|
| 3,591,868 | 7/1971 | Owens | 4/300 |
| 3,593,345 | 7/1971 | Wells | 4/318 |
| 3,727,242 | 4/1973 | Miller | 4/314 |
| 3,747,130 | 7/1973 | Sargent et al. | 4/321 |
| 3,751,735 | 8/1973 | Sargent et al. | 4/318 |
| 3,760,428 | 9/1973 | Kowal | 4/1 |
| 3,835,477 | 9/1974 | Moller | 4/300 X |
| 3,846,847 | 11/1974 | Tufts et al. | 4/320 |
| 3,908,202 | 9/1975 | Sargent et al. | 4/300 |
| 3,932,901 | 1/1976 | Inui et al. | 4/332 |
| 3,939,500 | 2/1976 | Miller et al. | 4/332 |

*Primary Examiner*—Henry K. Artis
*Attorney, Agent, or Firm*—Marvin Bressler; Linn I. Grim; T. J. Morgan

[57] ABSTRACT

A water closet shell comprising a basin component formed in one piece of molded plastics material and a cistern component likewise formed and when assembled defines a water closet unit having a flushing rim section. The flushing rim section is defined by mating an upwardly projecting ridge from the basin with a downwardly projecting ridge from the flushing rim.

10 Claims, 6 Drawing Figures

WATER CLOSETS

The present invention relates to water closets and more particularly to a novel water closet formed of plastics material.

Water closets for residential use have traditionally been formed of ceramic materials, and have comprised a bowl and a separate tank or cistern mounted thereupon. Such water closets are relatively expensive to fabricate and are rather heavy and thus costly and cumbersome to handle and ship.

It has, in the past, been proposed to form at least part of a water closet of plastic material. By such proposals it was intended that fabrication costs and weight of the water closet would be reduced. Proposals in this area are exemplified by the following patents: Owens U.S. Pat. No. 3,591,868 issued July 13, 1971; Wells U.S. Pat. No. 3,593,345 issued July 20, 1971; Miller U.S. Pat. No. 3,727,242 issued Apr. 17, 1973; Sargent et al U.S. Pat. No. 3,747,130 issued July 24, 1973; Sargent et al U.S. Pat. No. 3,751,735 issued Aug. 14, 1973; Moller U.S. Pat. No. 3,835,477 issued Sept. 17, 1974; Tufts et al U.S. Pat. No. 3,846,847 issued Nov. 12, 1974; Sargent et al U.S. Pat. No. 3,908,202 issued Sept. 30, 1975; and Inui et al U.S. Pat. No. 3,932,901 issued Jan. 20, 1976.

For the most part, however, non-ceramic water closets have met with only limited commercial success, being confined mostly to markets requiring small scale types of water closets, such as marine vessels, for example. Many of the prior art proposals involve water closets to be formed of numerous pieces which can require substantial time for assembly. In addition, the proposed designs often involve shapes that are difficult to fabricate in an economical manner. Other proposed designs constitute a relatively radical departure from the traditional appearance of water closets and thus involve significant marketing problems.

It would, therefore, be desirable to provide a plastics water closet having traditional-type bowl and tank portions formed of a minimal number of easily-fabricated and easily assembled parts.

However, this poses the difficult problem of how to form a water-discharging channel, whereby the bowl can be effectively flushed, and the means whereby said channel communicates with the cistern tank, whilst using only a minimal number of components. It will be appreciated that any increase in the number of components will increase costs.

Furthermore, it is clearly desirable to minimise the danger of water leakage from the assembled water closet and to avoid uncovered germ traps.

The present invention now provides a water closet shell comprising: (a) a basin component formed in one piece of molded plastics material and having an upwardly open bowl, an open waste outlet, a water inlet passage having a discharge opening into the bowl adjacent the top thereof, and an inlet opening, and a supporting portion whereby the basin may be supported in place, and (b) a cistern component formed in one piece of molded plastics material and having an upwardly open tank including an outlet opening adapted to be in register with said inlet opening of said water passage when the water closet is assembled, whereby said tank communicates with said water passage; and a flushing rim section including: a connecting wall extending from said tank and adapted to surmount the bowl when the water closet is assembled, and a sleeve adapted to project downwardly from said connecting wall and into said bowl when the water closet is assembled, the sleeve then being spaced inwardly from the upper end of said bowl and from the discharge end of said water passage to define with said bowl a downwardly open flushing channel extending around the upper end of said bowl.

A one-piece lid component is preferably provided, which can be removably disposed atop the cistern to cover the tank.

Preferably, the said basin includes an upwardly projecting ridge and said flushing rim includes a downwardly projecting ridge; said downwardly projecting ridge being arranged to mate with said upwardly projecting ridge, when said water closet is assembled, the ridges then surrounding the sleeve. The upwardly projecting ridge may be simply formed by the rim of the bowl itself.

The supporting portion preferably extends downwardly for supporting the basin on a foundation. However, the invention is not limited to this pedestal type of water closet, but can be applied to the corbel type; the supporting portion will then be constituted by lugs or the like to permit wall mounting.

The invention may be better understood from the following detailed description of a preferred embodiment of the invention in connection with the accompanying drawings in which like numerals designate like elements, and in which.

A preferred form of water closet (or "water closet suite") 10 according to the invention comprises a basin (or "pan") 12, a cistern 14, and a cistern lid 16. These water closet components are each of one-piece construction and formed of a suitable plastics material, such as polyacetal. For example, a suitable polyoxymethylene copolymer or homopolymer may be employed. A suitable molding technique, such as injection molding can be employed to form each component in one piece.

Figure 6:
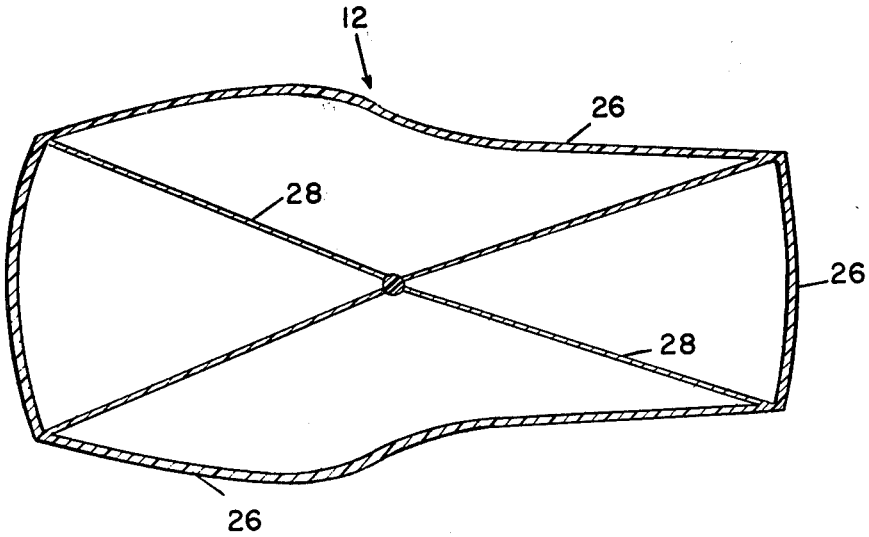
FIG. 6 is a horizontal cross-sectional view taken along line 6—6 of FIG. 2.

The one-piece basin 12 includes a downwardly tapering bowl-defining wall 18 and a rearwardly directed waste outlet 22, with a U-shaped trap 24 formed at the junction thereof. Projecting downwardly from these bowl, outlet, and trap sections are generally upright support walls 26 which form a box-like floor support section. These support walls include diagonal brace walls 28 (FIG. 6) which extend diagonally across the bottom of the support section.

(It should be mentioned that directional terms, such as "horizontal", "vertically", "rearwardly" and "downwardly", herein refer to the disposition of the parts in the water closet as assembled in place.)

The bowl-forming wall 18 terminates upwardly in a generally oval-shaped edge or rim 30. Wall 18 extends downwardly and inwardly from the edge or rim 30.

Figure 5:
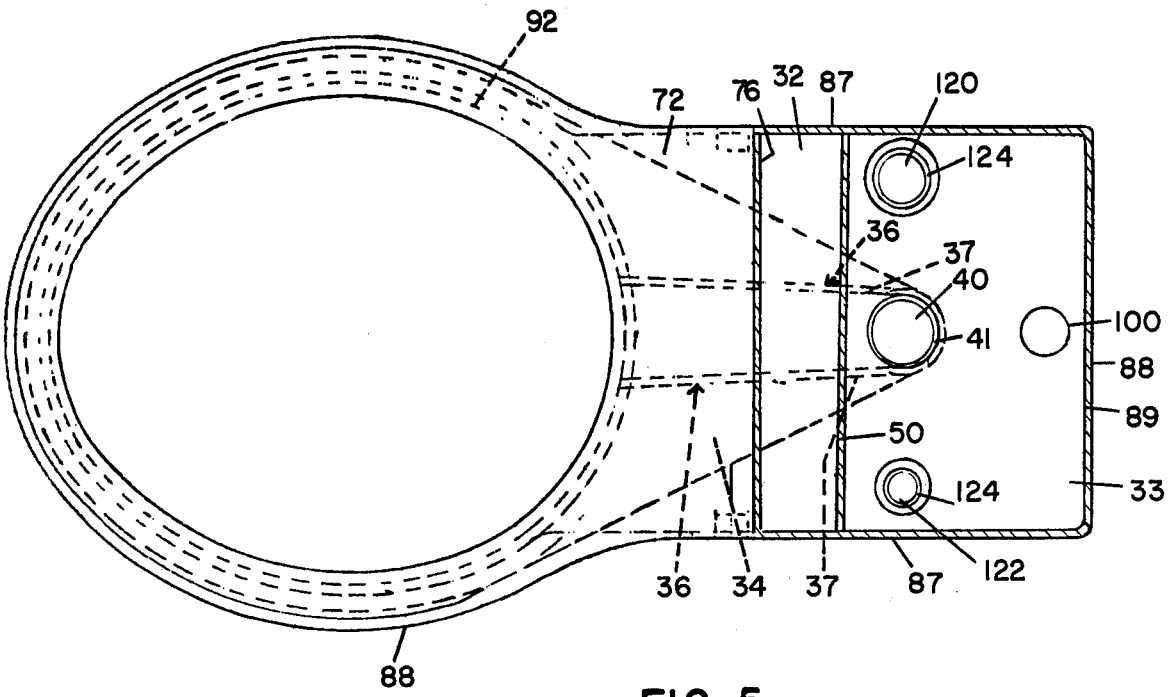
FIG. 5 is a horizontal cross-sectional view taken along line 5—5 of FIG. 2.

The basin 12 further includes a laterally extending top wall 32 which is of generally rectangular configuration when viewed from above (FIG. 5). Situated beneath the top wall is a generally V-shaped, horizontally arranged lower wall 34. Interconnecting the top wall 32 and lower wall 34 is an upright side wall 36 which defines, with the top and lower walls, a water passage 38. This passage 38 includes a rearwardly located inlet opening 40 and a forwardly located discharge opening 42 which opens into the bowl-defining wall 18 at the upper end thereof just below the top edge 30. The inlet opening 40 is surrounded by an upstanding annular lip 41.

The side wall 36 includes fore-to-aft extending sections 37 which diverge in a forward direction, e.g., about 3 degrees, to provide a passage 38 which widens as it approaches the bowl 20, to facilitate water flow through the passage with minimal back-up.

Figure 4:
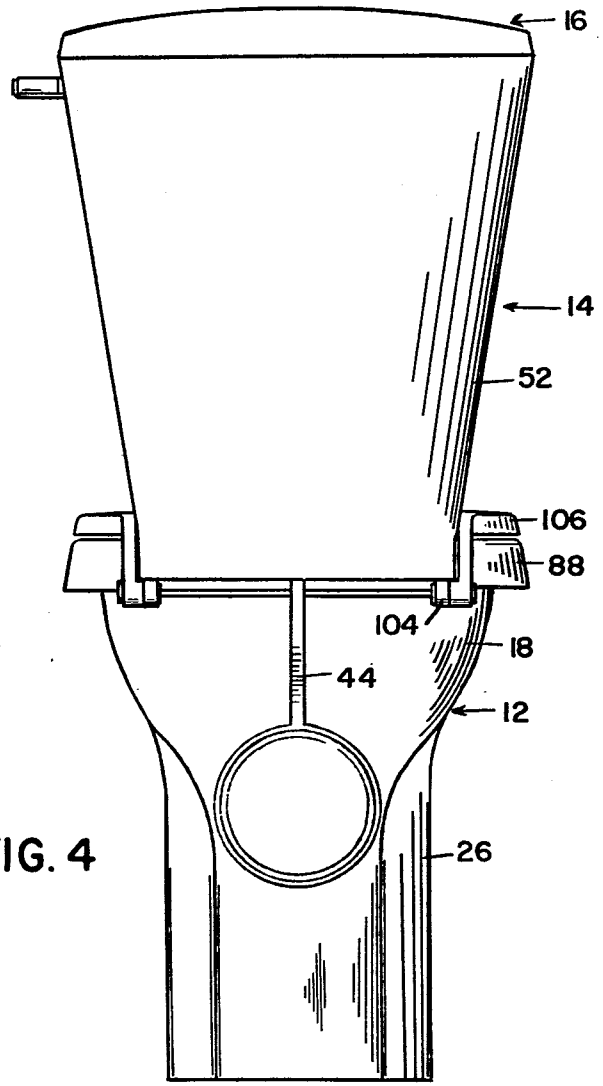
FIG. 4 is a rear elevational view of the water closet of FIG. 2.
Figure 3:
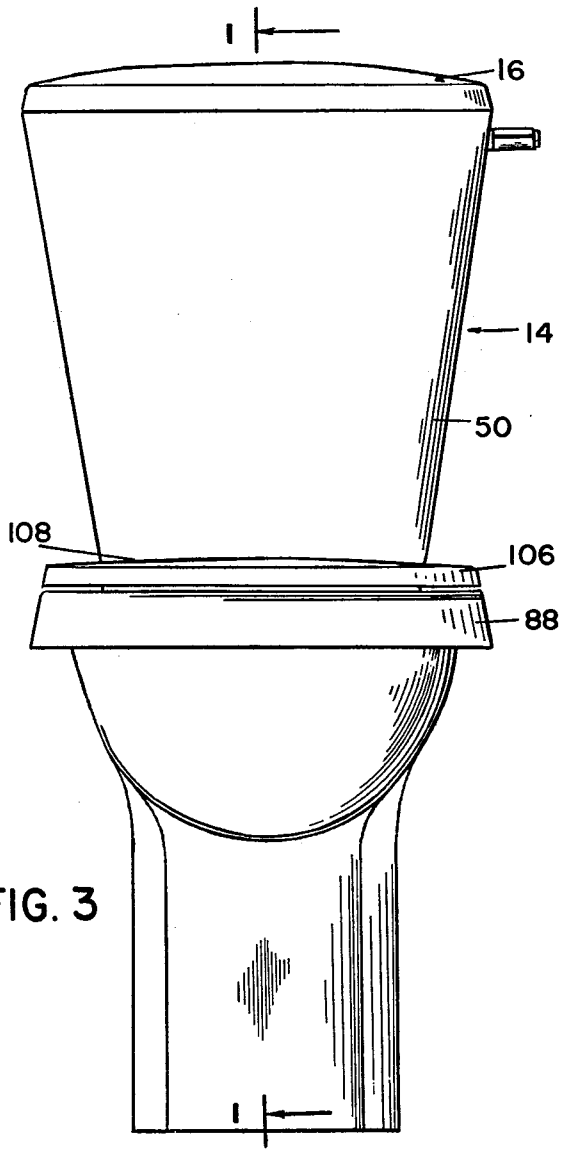
FIG. 3 is a front elevational view of the water closet of FIG. 2.

The top wall 32 includes a portion 33 which extends rearwardly of the inlet opening 40, and joins with an upstanding web 44 which is situated at the rear of the bowl, intermediate the sides thereof (FIG. 4).

A horizontally arranged flange 45 which extends around the bowl 20 beneath the upper edge 30.

The one-piece cistern 14 includes upright front and rear walls 50, 52 and a bottom wall 54, which form an upwardly open tank 56. A vertically oriented outlet opening 58 is positioned in the bottom wall 54 in alignment with the inlet opening 40 of the water passage 38. The outlet opening 58 is defined by an upright cylindrical section 59 whose lower end 60 projects below the bottom wall 54. The lower end 60 of the cylindrical section is sized to mate with the annular lip 41 which surrounds the inlet opening 40 of the basin 12. Preferably, the inner wall 62 of the lip 41 flares outwardly in an upward direction and the outer wall 64 of the cylindrical section 60 tapers inwardly in a downward direction so that the outer wall 64 can rest within the inner wall 62. In this fashion, the tank 56 can be placed in fluid communication with the bowl 20 via the passage 38.

The cistern 14 further includes a flushing rim member 70. This rim member includes a connecting wall 72 extending horizontally, forwardly from the front wall 50 of the tank. The rear end 76 of the connecting wall 72 is curved upwardly and merges with the tank front wall 50 at a location 78 spaced above the bottom wall 54 of the cistern.

Forming an opening 80 at the front end of the connecting wall 72 is an upright generally oval-shaped sleeve 82. The sleeve 82 depends downwardly from the connecting wall 72 and is sized to be received within the bowl 20 to define with the wall 18 an annular, downwardly open flushing channel 84 extending around the upper end of the bowl 20.

A skirt 88 projects downwardly from the periphery of the connecting wall 72. The skirt 88 is spaced outwardly of the sleeve 82 and extends around the wall 18 of the bowl 20, along the front-to-rear extending edges 87 of the top wall 32 of the basin, and along a rear edge 89 of the top wall. In this fashion, the skirt completely surrounds the mating surfaces of the cistern and bowl. Consequently, the skirt 88 and connecting wall 72 of the cistern cooperate to completely cover crevises or recesses which could constitute a germ trap.

In order to connect the cistern 14 and basin 12 together, any suitable form of attachment may be employed, such as snap couplings, adhesives, etc., which are employed with appropriate seals.

Preferably, however, a welded connection is employed. To this end, the upper edge 30 of the bowl-defining wall 18 extends higher than the top wall 32, to define an upwardly projecting ridge 90. Projecting downwardly from the connecting wall 72 of the cistern 14 is a correspondingly shaped ridge 92. When the cistern 14 is installed upon the basin, the ridge 92 of the cistern rests atop the ridge 90 of the basin. Thus, by melting one or both of these ridges prior to installation, as by a conventional hot plate welding technique, the ridges will fuse together upon subsequent hardening of the plastic.

In similar fashion, the lip 41 disposed around the inlet opening 40 of the basin, and the lower portion 60 of the cylindrical portion 59 of the cistern can also be fused together.

Additional rigidity can be established by providing projections 100, 102 on the top wall 32 of the basin and the bottom wall 54 of the cistern, respectively. One or both of these projections are melted prior to installation and are subsequent fused together.

Figure 1:
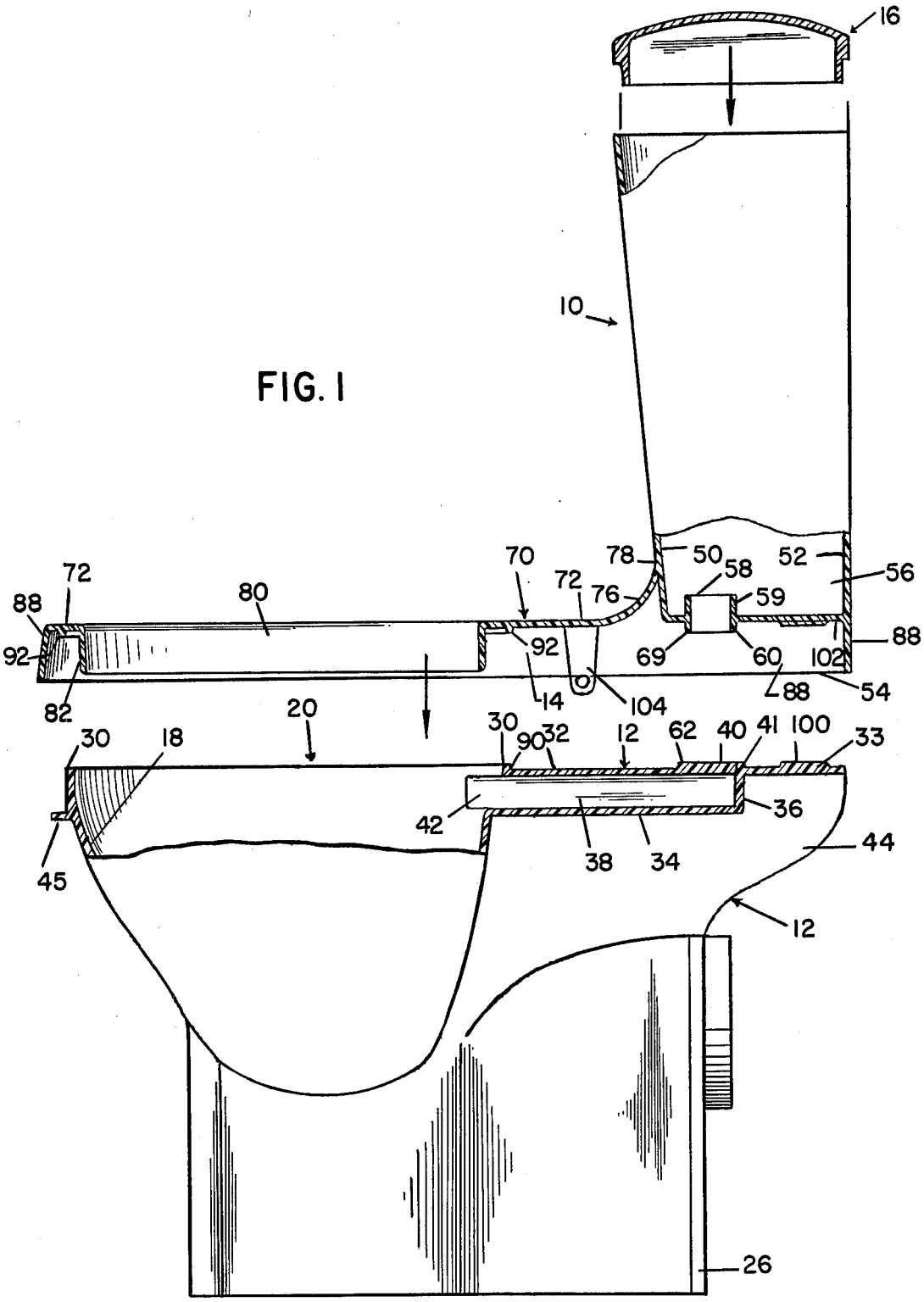
FIG. 1 is an exploded side elevational view, partly in vertical cross-section, of the components forming a water closet shell according to the present invention.
Figure 2:
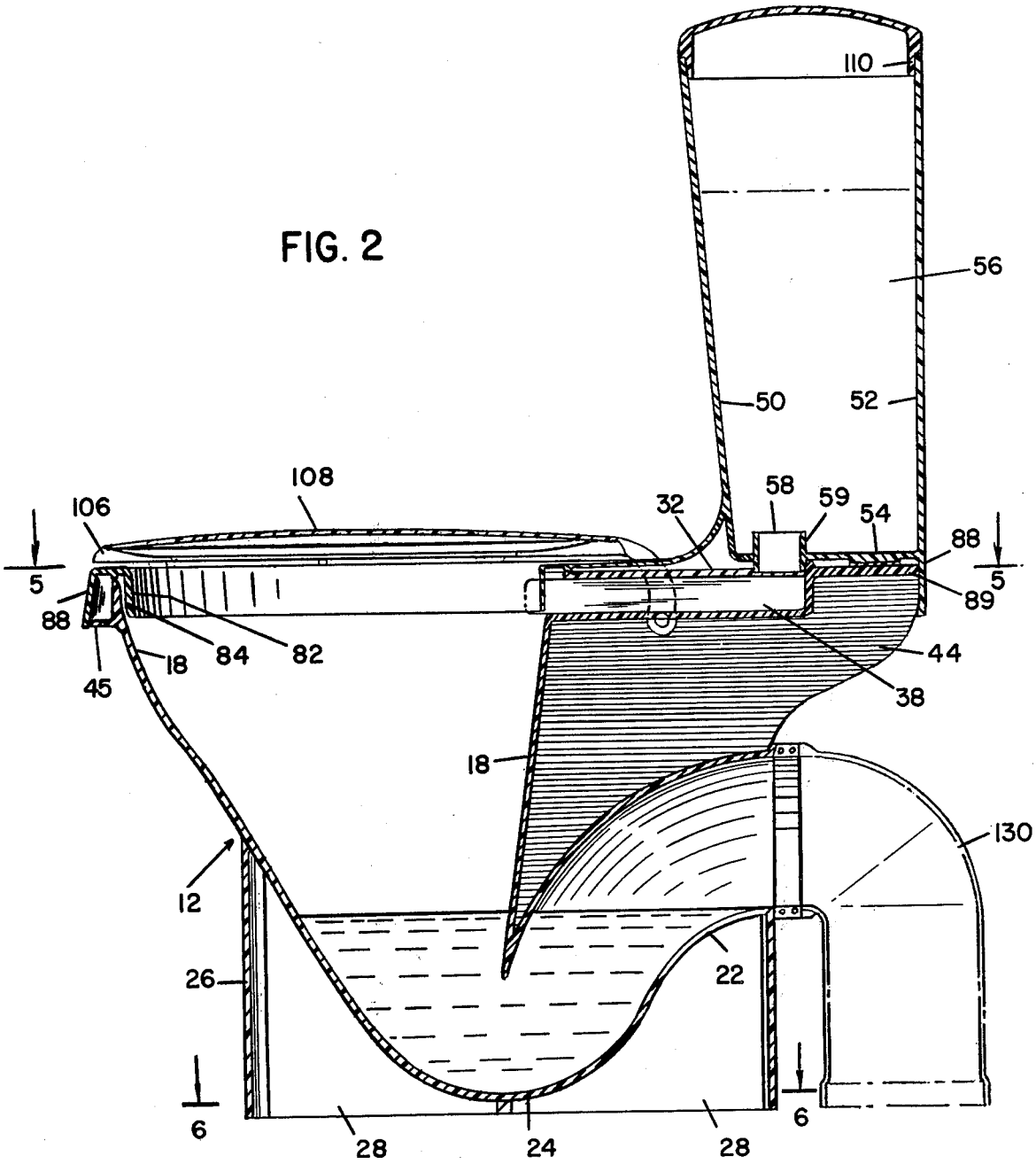
FIG. 2 is a side elevational view, in vertical cross-section, of an assembled water closet including seat and cover elements.

The rim 70 of the cistern can be provided with downwardly projecting flanges 104 (FIG. 1) for pivotably mounting conventional seat and cover members 106, 108 (FIG. 2).

With the cistern 14 mounted upon the basin 12, the cistern is supported upon the bowl-defining wall 18 and the top wall 32 of the basin. The outlet 58 of the cistern communicates with the inlet 40 of the water passage 38 of the basin. The sleeve 82 of the cistern cooperates with the bowl-defining wall 18 of the basin to define a downwardly open water discharge channel 84. All potential germ traps are effectively covered since the rim 70 extends integrally from the tank wall 50 at location 78, and the skirt 88 extends completely around the joinder plane between the cistern and basin. The lid 16 includes a flange 110 which fits within the upper end of the tank 56 to close the tank.

The top wall 32 of the basin is preferably provided with ports 120, 122 which are located laterally of the passage 38 and are aligned with corresponding ports (not shown) in the tank, to accommodate the passage of water pipes to the tank. These ports can be provided with welded ridges 124 similar to the portions 60, 41 of the passages 58, 40, for forming a weld to effect a sealed connection therebetween.

It will be realized that the present invention provides a water closet having traditional bowl, waste outlet, upright cistern tank, and tank lid features. However, these features are embodied in a shell consisting of only three plastic components 12, 14, 16. The manufacturing costs involved are considerably less than that of conventional ceramic water closets and the resulting product is significantly lighter and more easily handled.

Although the components 12, 14, 16 constitute separate pieces, which are to be connected together, there are virtually no exposed germ traps that would present a health hazard. That is, the rim 70 is integral with the tank wall 50 and extends therefrom in a manner avoiding the formation of an open crevice. Moreover, the skirt 88 extends completely around the joinder plane of the cistern and basin to cover this area.

Leakage problems are minimized since the water passage 38 is formed solely by walls of the basin component, rather than by cooperating walls of the cistern and basin.

The basin is effectively supported by the support walls 26, 28 which constitute a highly rigid bracing arrangement that amply carries the expected loading.

The components are conveniently fabricated by conventional molding techniques. This is facilitated by the formation of the channel 84 from cooperating walls 18, 82 of separate ones of the components, rather than forming such channel 84 of one-piece.

Interconnection of the basin 12 and cistern 14, which is preferably accomplished by welding, is facilitated by the presence of mating weld ridges 90, 92 that can be easily melted and fused. The welded joint thus produced extends around the water channel 84 to provide an effective seal therefor. Ample securement for the components 12, 14 is further assured by the weld projections 100, 102 at the rear end of the water closet. In addition, the nesting connection between the tank outlet 58 and the inlet 40 of the water passage 38 provides an effective seal and further secures the components together. The expanding cross-section of the channel 38 from back to front facilitates rapid flushing.

As shown in FIG. 2, the flange 45 substantially seals off the recess formed by the skirt 88 and the outer wall of the bowl 18. Thus, the accumulation of grime in the recess may be avoided and the underneath of the flange 45 presents a surface that is readily cleaned. Moreover, although skirt 88 and flange 45 need not be welded or otherwise joined, they still form a kind of box-section that imparts extra rigidity to the flushing rim structure.

Various modifications to the above-described embodiment are, of course, possible. For example, the bowl 18 may be formed with beading that will cooperate with the lower edge of the sleeve 82 to form a series of discrete outlets in the flushing channel.

Furthermore, although the lower wall 34 is shown as geing generally V-shaped, it is possible to dispense with those parts of the wall 34 that do not form the actual floor of the water passage 38. In this case, the flange 45 may continue round the rear of the bowl until it merges with the lower wall 34, or it may be terminated before that point.

The outlet 58 of the tank and the inlet 40 of the water passage require careful alignment to avoid leakage problems. It is possible that shrinkage during moulding may cause the centres of these openings to move slightly out of register. To overcome this problem, an alternative construction is possible.

The rim 41 may be made with an internal diameter that is slightly larger than the external diameter of the rim 60. The rim 41 extends sufficiently to ensure that, upon assembly, it abuts either the lower face of wall 54 or a flange which may be provided around the rim 60, and can be welded or otherwise joined thereto in a water-tight fashion. The rim 60 will then be surrounded by the rim 41 and the difference in diameter will permit a certain tolerance in the alignment of the respective centres of outlet 58 and inlet 40.

To complete the water closet suite, the water closet shell of the present invention can be equipped with the toilet seat and cover and the cistern internals (e.g. the syphon leg, operating mechanism and overflow pipe) in the customary manner. The waste outlet can be connected to the soil pipe by a suitable conduit 130 (FIG. 2). Furthermore, although the illustrated embodiment is a water-closet of the washdown type, the invention is applicable to water closets having a syphonic action.

What we claim is:

1. A water closet shell comprising:

(a) a basin component formed in one piece of molded plastics material and having an upwardly open bowl, an open waste outlet, a water inlet passage having a discharge opening into the bowl, adjacent the top thereof, and an inlet opening, and a supporting portion whereby the basin may be supported in place; and (b) a cistern component formed in one piece of molded plastics material and having an upwardly open tank including an outlet opening adapted to be in register with said inlet opening of said water passage when the water closet is assembled, whereby said tank communicates with said water passage; and a flushing rim section including: a connecting wall extending from said tank and adapted to surmount the bowl when the water closet is assembled, and a sleeve adapted to project downwardly from said connecting wall and into said bowl when the water closet is assembled, the sleeve then being spaced inwardly from the upper end of said bowl and from the discharge end of said water passage to define with said bowl a downwardly open flushing channel extending around the upper end of said bowl.

2. A water closet shell according to claim 1 wherein said basin includes an upwardly projecting ridge and said flushing rim includes a downwardly projecting ridge; said downwardly projecting ridge being arranged to mate with said upwardly projecting ridge, when said water closet is assembled, the ridges then surrounding the sleeve.

3. A water closet shell according to claim 2, wherein the said upwardly projecting ridge is formed by the top edge or rim of the bowl.

4. A water closet shell according to claim 3 wherein said connecting wall includes an upwardly curved rearward end which merges with a forward tank-defining wall of said cistern at a level above the lower end of said forward wall.

5. A water closet shell according to claim 4, wherein the flushing rim includes a downwardly projecting skirt which is adpated to extend completely around a joinder plane between said cistern and bowl components in the assembled water closet.

6. A water closet shell according to claim 5 wherein said water inlet passage includes a horizontally disposed top wall extending from said bowl and rearwardly of said passage inlet opening; said skirt extending outwardly of and completely around the periphery of said top wall.

7. A water closet shell according to claim 1 wherein said water inlet passage expands in cross-section from its inlet end to its outlet end.

8. A water closet shell according to claim 5 wherein said flushing rim includes downwardly projecting flanges for pivotably mounting a seat and a cover.

9. A water closet shell according to claim 8 which includes a removable one-piece lid for the cistern tank.

10. A water closet shell according to claim 9 in which the supporting portion extends downwardly for supporting the basin on a foundation.

* * * * *